US009541884B1

(12) United States Patent
Kawai

(10) Patent No.: US 9,541,884 B1
(45) Date of Patent: Jan. 10, 2017

(54) INTERMITTENT DRIVING DEVICE AND IMAGE FORMING APPARATUS

(71) Applicant: FUJI XEROX CO., LTD., Tokyo (JP)

(72) Inventor: Jun Kawai, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 15/007,855

(22) Filed: Jan. 27, 2016

(30) Foreign Application Priority Data

Sep. 4, 2015 (JP) ..... 2015-174283

(51) Int. Cl.
*G03G 15/00* (2006.01)
*G03G 21/18* (2006.01)

(52) U.S. Cl.
CPC ..... *G03G 15/757* (2013.01); *G03G 21/1857* (2013.01)

(58) Field of Classification Search
CPC ..... G03G 15/757; G03G 15/1615; G03G 21/1857; G03G 2221/1657
See application file for complete search history.

(56) References Cited

U.S. PATENT DOCUMENTS

2010/0104311 A1* 4/2010 Okamoto ..... G03G 15/6502 399/75
2013/0223906 A1* 8/2013 Tomatsu ..... G03G 15/757 399/361
2015/0248100 A1* 9/2015 Hayakawa ..... G03G 15/757 399/167
2015/0277354 A1* 10/2015 Fukamachi ..... G03G 15/0865 399/12

FOREIGN PATENT DOCUMENTS

JP 2008-95870 A 4/2008
JP 2008-164151 A 7/2008
JP 2011-185293 A 9/2011

* cited by examiner

*Primary Examiner* — Sandra Brase
(74) *Attorney, Agent, or Firm* — Sughrue Mion, PLLC

(57) ABSTRACT

An intermittent driving device includes a shaft, an input gear, an output gear, a connecting member that rotates in a state of being connected to the input gear, a state of the connecting member being switched between a state of being connected to the output gear and a state of being disconnected from the output gear, a moving member, a cam member that has a cam surface having a shape that causes the moving member to move in the axial direction and guides the connecting member into the state of being connected to the output gear or the state of being disconnected from the output gear, a rotation-applying member that applies a rotational driving force to the cam member, and a switching member that switches between a state where a rotational operation of the cam member is hindered and a state where the rotational operation is allowed.

17 Claims, 14 Drawing Sheets

INTERMITTENT DRIVING DEVICE AND IMAGE FORMING APPARATUS

CROSS-REFERENCE TO RELATED APPLICATIONS

This application is based on and claims priority under 35 USC 119 from Japanese Patent Application No. 2015-174283 filed Sep. 4, 2015.

BACKGROUND

Technical Field

The present invention relates to an intermittent driving device and an image forming apparatus.

SUMMARY

According to an aspect of the invention, there is provided an intermittent driving device including a shaft, an input gear that is rotatably supported by the shaft, an output gear that is rotatably supported by the shaft, a connecting member that is urged and movably supported in an axial direction and that rotates in a state of being connected to the input gear, a state of the connecting member being switched between a state of being connected to the output gear and a state of being disconnected from the output gear, a moving member that is supported in such a manner as to be capable of moving together with the connecting member, a cam member that is supported by the shaft in such a manner as to be capable of rotating as a result of receiving a driving force of a drive gear and that has a cam surface having a shape that causes the moving member to move in the axial direction and guides the connecting member into the state of being connected to the output gear or the state of being disconnected from the output gear, a rotation-applying member that applies a force that causes the cam member to rotate around the shaft to the cam member, and a switching member that switches between a state where a rotational operation of the cam member is hindered and a state where the rotational operation is allowed.

BRIEF DESCRIPTION OF THE DRAWINGS

An exemplary embodiment of the present invention will be described in detail based on the following figures, wherein.

DETAILED DESCRIPTION

Figure 1:
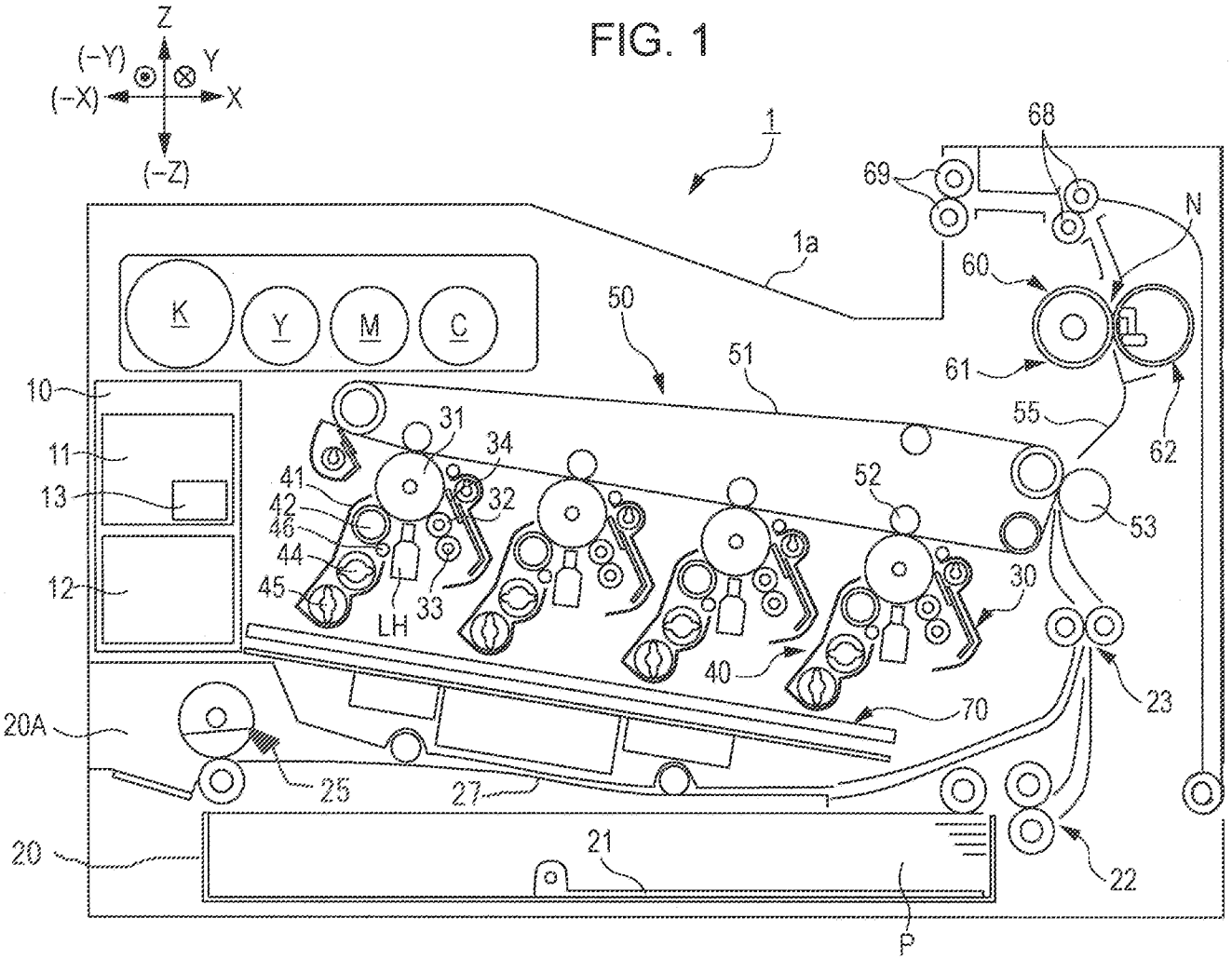
FIG. 1 is a schematic sectional view illustrating an internal structure of an image forming apparatus.

An exemplary embodiment of the present invention will now be described in detail below using a specific example and with reference to the drawings. However, the present invention is not limited to the following exemplary embodiment and specific example.

In addition, objects are schematically illustrated in the drawings that will be referred to in the following description, and it should be noted that dimensional ratios and so forth of the objects illustrated in the drawings are different from those of actual objects. In the drawings, illustration of components that are not necessary for the following description is suitably omitted for ease of understanding.

Note that, a front-rear direction, a left-right direction, and a top-bottom direction are respectively defined as the X-axis direction, the Y-axis direction, and the Z-axis direction for ease of understanding of the following description, in the drawings.

(1) Overall Configuration and Operation of Image Forming Apparatus

FIG. 1 is a schematic sectional view illustrating the internal structure of an image forming apparatus 1 according to an exemplary embodiment.

The overall configuration and the operation of the image forming apparatus 1 will be described below with reference to the drawings.

The image forming apparatus 1 includes a control device 10, a sheet-feeding device 20, photoconductor units 30, developing units 40, a transfer device 50, a fixing device 60, a power supply unit 70, and a driving-force-transmission device 100 (illustrated in FIG. 2). An ejection tray 1*a* is formed in a top surface of the image forming apparatus 1 (in the Z-axis direction), and a sheet in which an image has been recorded is to be ejected to and accommodated in the ejection tray 1*a*.

The control device 10 includes an image-forming-apparatus controller 11 that controls the operation of the image forming apparatus 1, a controller unit 12 that prepares image data that corresponds to a request for a printing operation, and a light-exposure controller 13 that controls turning on of light-exposure heads LH.

The controller unit 12 converts print information input from an external information-transmission apparatus (e.g., personal computer or the like) into image information for use in latent image formation and outputs a driving signal to each of the light-exposure heads LH at a predetermined timing. Each of the light-exposure heads LH according to the present exemplary embodiment is formed of an LED head that includes plural light-emitting devices, which are light-emitting diodes (LED) and which are linearly arranged next to one another along a scanning direction.

The sheet-feeding device 20 is disposed in a bottom portion of the image forming apparatus 1. The sheet-feeding device 20 includes a sheet-stacking plate 21, and sheets P, which serve as a large number of recording media, are stacked on a top surface of the sheet-stacking plate 21. The sheets P that are stacked on the sheet-stacking plate 21 and positioned by a restricting plate (not illustrated) in a width direction of the sheets P are taken out forward (in the X-axis direction) one by one starting from the uppermost sheet P by a sheet-taking-out unit 22 and then transported to a nip part that is defined by a pair of registration rollers 23.

A second sheet-feeding device 20A is disposed above the sheet-feeding device 20. The second sheet-feeding device 20A transports one of the sheets P, which has been taken out by a sheet-taking-out unit 25, to the nip part defined by the pair of registration rollers 23 via a sheet transport path 27.

The photoconductor units 30 are arranged side by side above the sheet-feeding device 20 (in the Z-axis direction) and each include a photoconductor drum 31 serving as an image carrier that is driven so as to rotate. A charging roller 32, one of the light-exposure head LH, one of the developing units 40, a first transfer roller 52, and a cleaning blade 34 are arranged along a rotation direction of each of the photoconductor drums 31. Each of the charging rollers 32 is provided with a cleaning roller 33 that cleans a surface of the charging roller 32, and the cleaning roller 33 is disposed in such a manner as to face the charging roller 32 and to be in contact with the charging roller 32.

Each of the developing units 40 includes a developer housing 41 in which a developer is contained. In the developer housing 41, a developing roller 42, which is disposed in such a manner as to face the corresponding photoconductor drum 31, and augers 44 and 45, which are paired with each other and disposed diagonally below the developing roller 42 on the rear surface side of the developing roller 42. The augers 44 and 45 transport the corresponding developer to the side on which the corresponding developing roller 42 is disposed while stirring the developer. A layer-control member 46 that controls the layer thickness of the corresponding developer is disposed near the developing roller 42.

The configurations of the developing units 40 are similar to one another, except with regard to the developers contained in the developer housings 41, and each of the developing units 40 forms a toner image of one of yellow (Y), magenta (M), cyan (C), and black (K).

Surfaces of the photoconductor drums 31, which rotate, are charged by the corresponding charging rollers 32, and an electrostatic latent image is formed on each of the surfaces of the photoconductor drums 31 by latent-image-forming light emitted by the corresponding light-exposure head LH. Each of the electrostatic latent images formed on the photoconductor drums 31 is developed into a toner image by the corresponding developing roller 42.

The transfer device 50 includes an intermediate transfer belt 51, the first transfer rollers 52, and a second transfer roller 53. Toner images of different colors formed on the photoconductor drums 31 of the photoconductor units 30 are transferred onto the intermediate transfer belt 51 in such a manner that the toner images are superposed with one another. The first transfer rollers 52 sequentially transfer (in a first transfer process) the toner images of the different colors formed by the photoconductor units 30 onto the intermediate transfer belt 51. The second transfer roller 53 collectively transfers (in a second transfer process) the toner images of the different colors, which have been transferred to the intermediate transfer belt 51 in such a manner as to be superposed with one another, onto one of the sheets P.

The toner images of the different colors formed on the photoconductor drums 31 of the photoconductor units 30 are sequentially and electrostatically transferred (in the first transfer process) onto the intermediate transfer belt 51 by the first transfer rollers 52 to each of which a predetermined transfer voltage has been applied by the power supply unit 70, which is controlled by the image-forming-apparatus controller 11, and accordingly, a superposed toner image, which is formed of the toner images of the different colors superposed with one another, is formed.

Along with movement of the intermediate transfer belt 51, the superposed toner image on the intermediate transfer belt 51 is transported to a region (second transfer section T) in which the second transfer roller 53 is disposed. In accordance with the timing at which the superposed toner image is transported to the second transfer section T, one of the sheets P is fed to the second transfer section T from the sheet-feeding device 20. Then, a predetermined transfer voltage is applied to the second transfer roller 53 by the power supply unit 70, which is controlled by the image-forming-apparatus controller 11, and the superposed toner image on the intermediate transfer belt 51 is collectively transferred onto the sheet P, which has been sent out by the pair of registration rollers 23 and guided by a transport guide.

Toner that remains on the surface of each of the photoconductor drums 31 is removed by the corresponding cleaning blade 34 and collected into waste-developer containers. The surface of each of the photoconductor drums 31 is charged again by the corresponding charging roller 32. Note that residues that have not been removed by the cleaning blades 34 and that are deposited on the charging rollers 32 are captured and accumulated on the surfaces of the corresponding cleaning rollers 33, which rotate while being in contact with the corresponding charging rollers 32.

The fixing device 60 includes a heating module 61 and a pressing module 62, and a press-contact region between the heating module 61 and the pressing module 62 forms a fixing nip part N (fixing region).

In the transfer device 50, one of the sheets P to which toner images have been transferred is transported to the fixing device 60 via the transport guide while the toner images are unfixed to the sheet P. The toner images are fixed onto the sheet P, which has been transported to the fixing device 60, by the heating module 61 and the pressing module 62, which are paired with each other, as a result of the toner images being heated and pressurized.

The sheet P on which the toner images have been formed and to which the toner images have been fixed is ejected to the ejection tray 1*a*, which is formed in the top surface of the image forming apparatus 1, by a pair of ejection rollers 69 via a pair of transport rollers 68.

(2) Driving-Force-Transmission Device

Figure 2A:
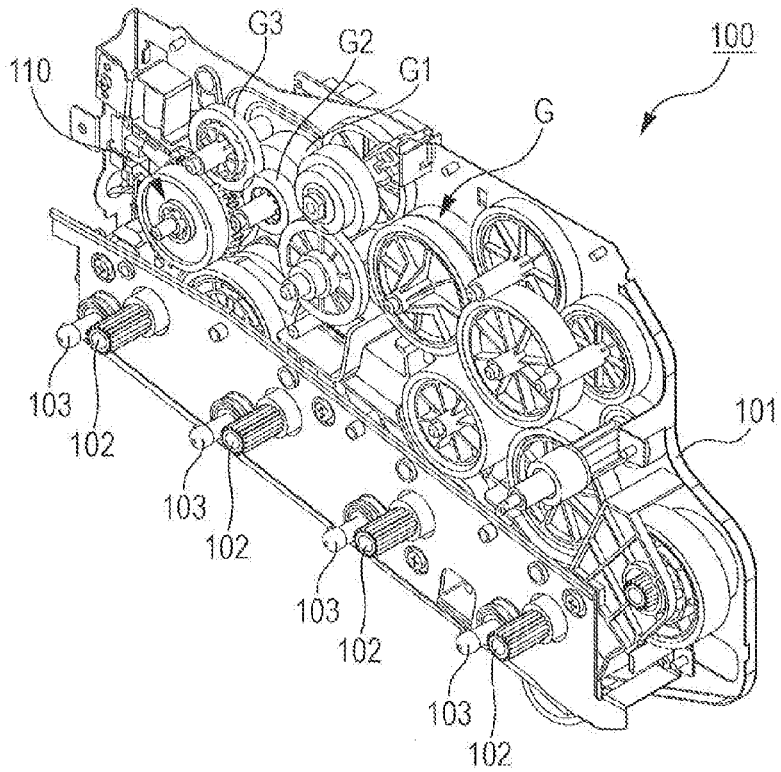
FIGS. 2A and 2B are respectively a perspective view illustrating a driving-force-transmission device that includes an intermittent driving device focusing on the side where transmission of a driving force is performed and a plan view focusing on the side where the transmission of the driving force is performed.
Figure 2B:
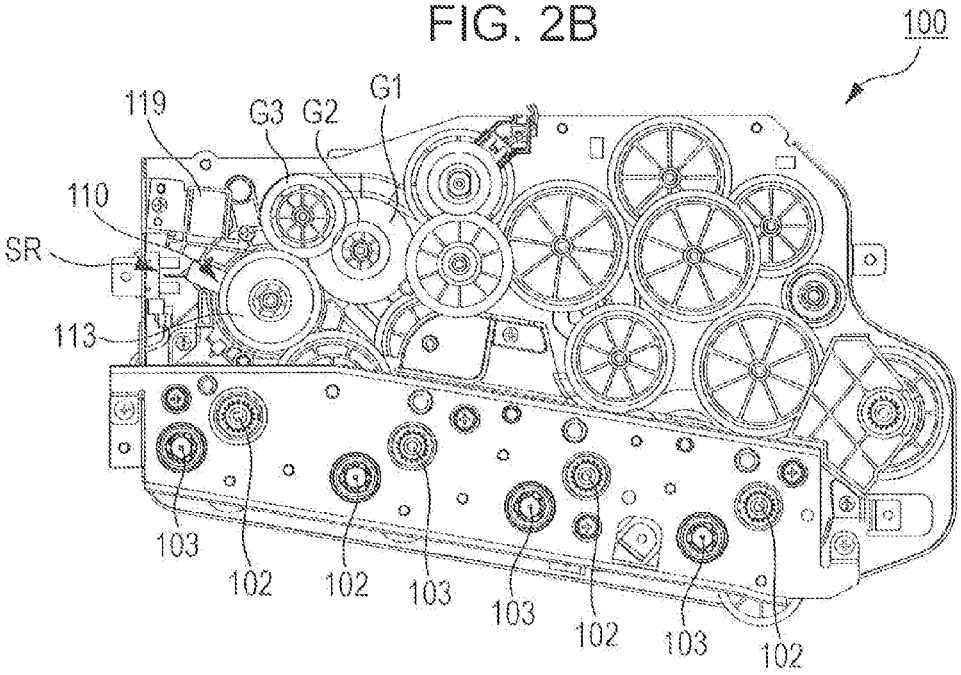
Figure 3:
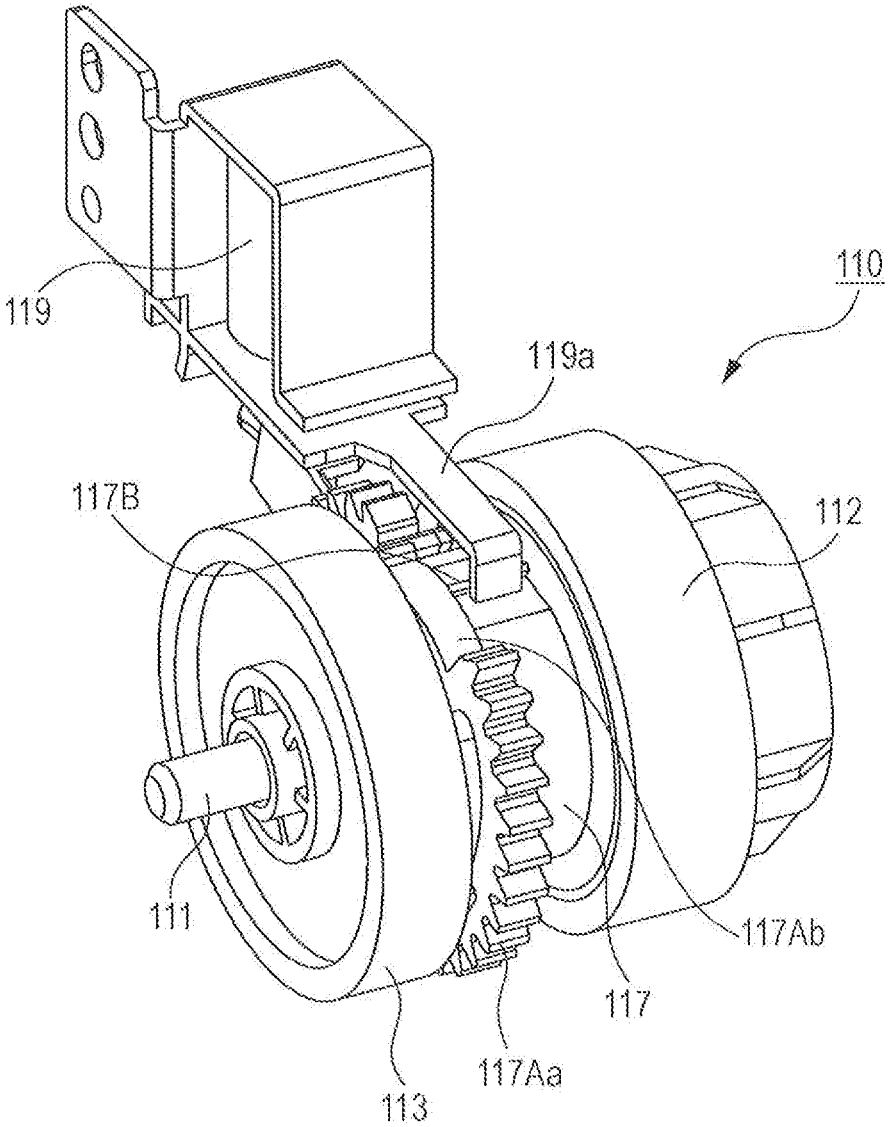
FIG. 3 is a perspective view illustrating a principal portion of the intermittent driving device.
Figure 4:
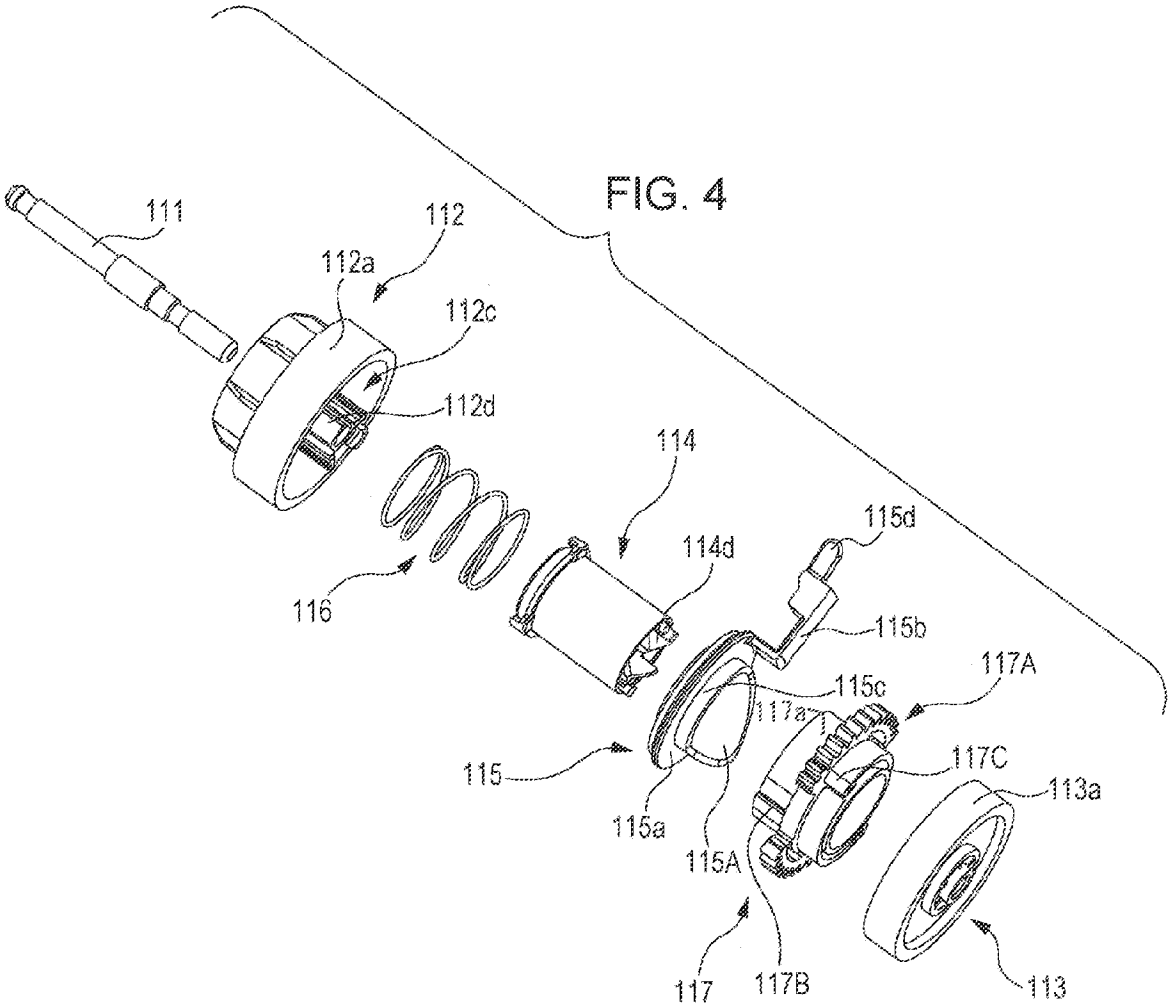
FIG. 4 is an exploded perspective view illustrating the principal portion of the intermittent driving device.
Figure 5B:
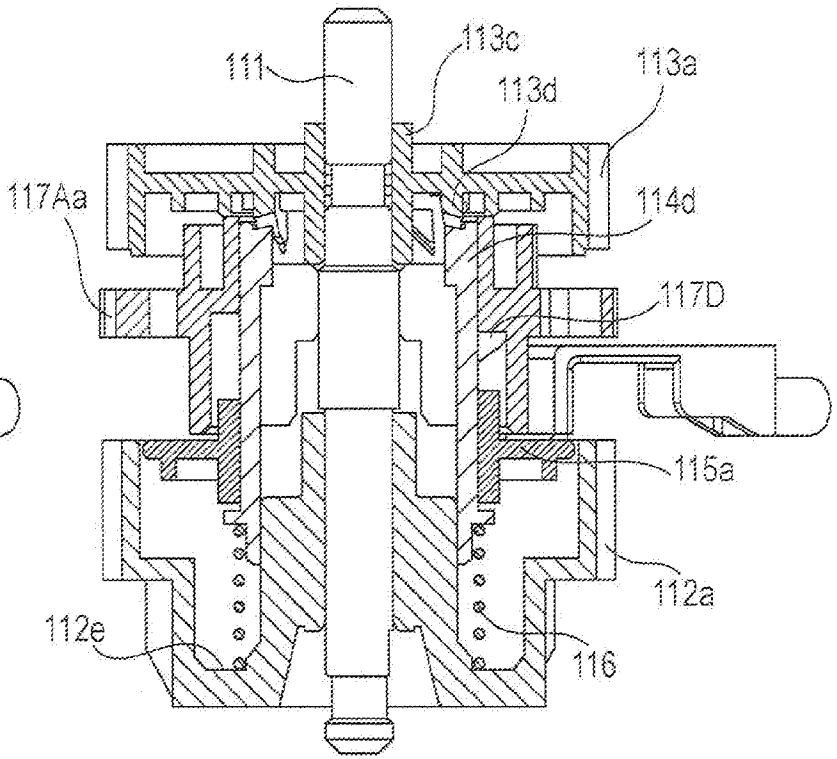
FIGS. 5A and 5B are respectively a plan view and a schematic sectional view each illustrating the principal portion of the intermittent driving device.
Figure 5A:
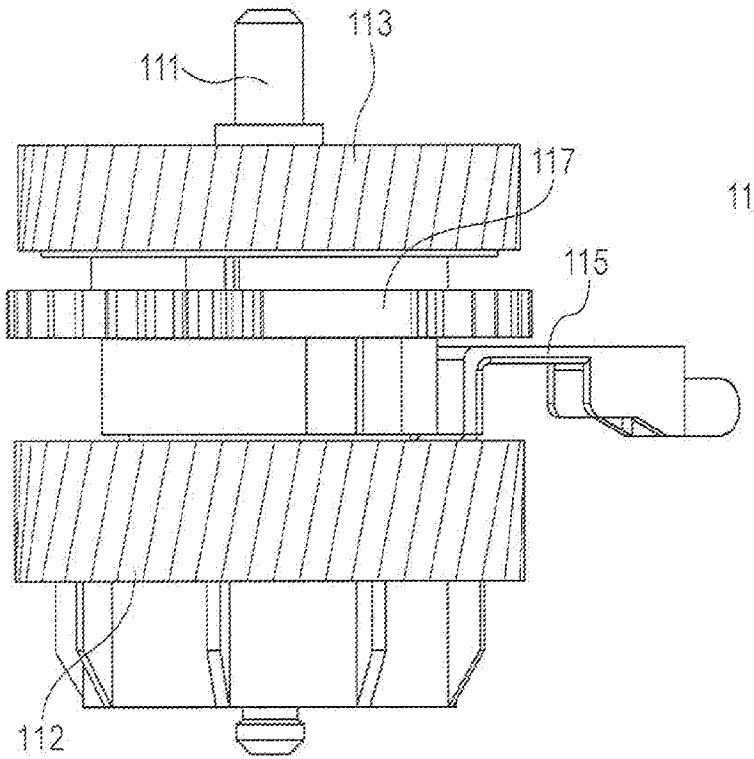
Figure 6A:
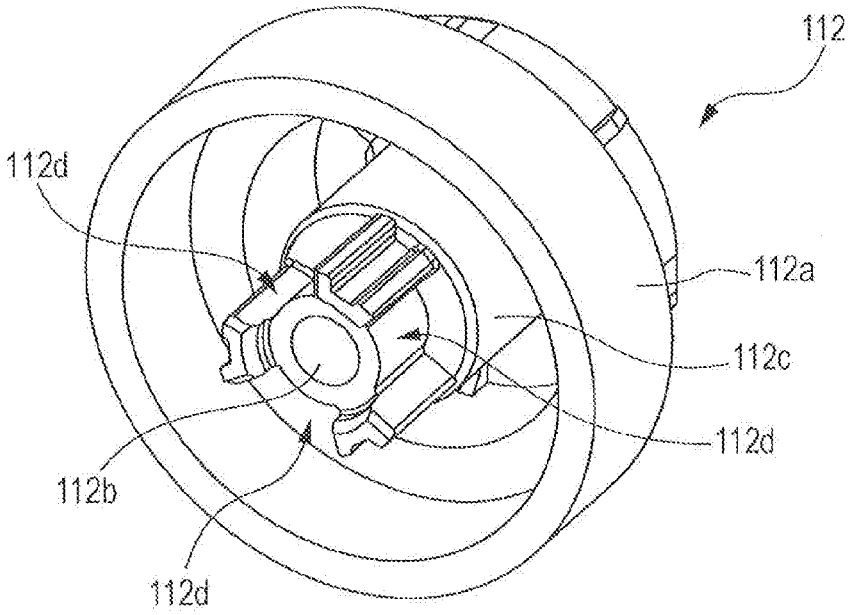
FIGS. 6A and 6B are perspective views each illustrating an input gear.
Figure 6B:
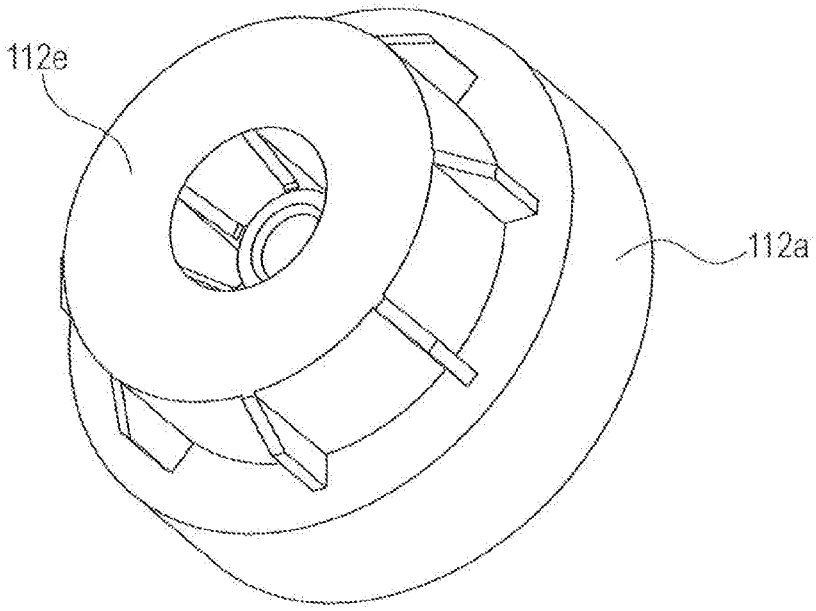
Figure 7A:
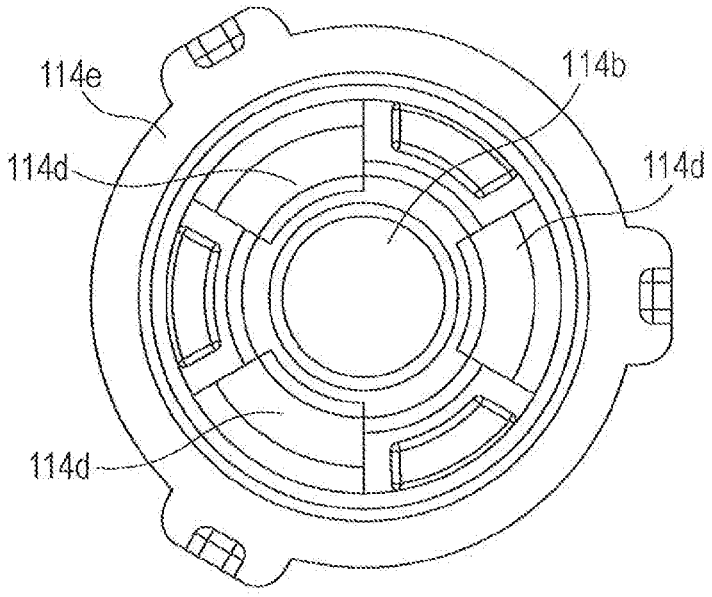
FIGS. 7A and 7B are respectively a front view of a connecting member on the side on which the input gear is disposed and a perspective view focusing on the side on which connecting protrusions are present.
Figure 7B:
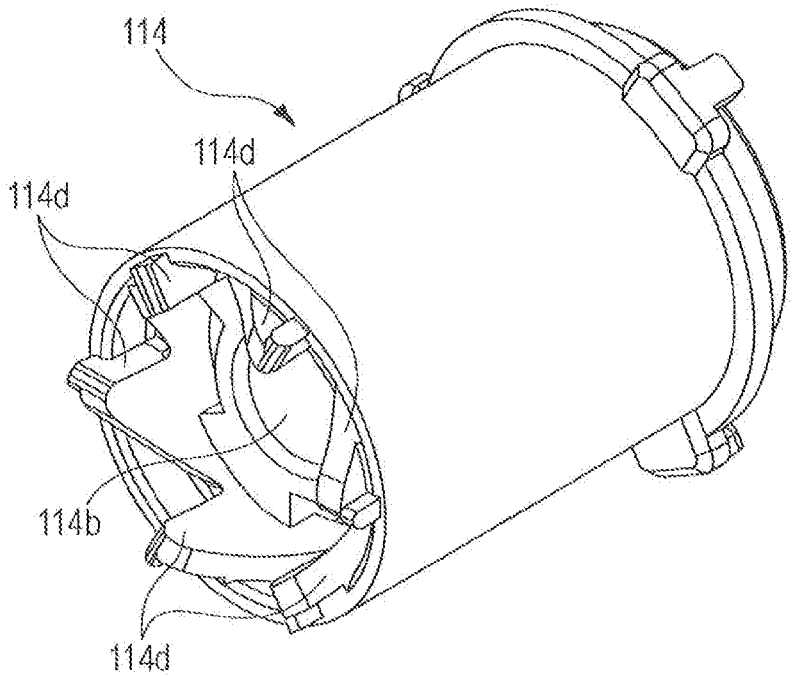
Figure 8:
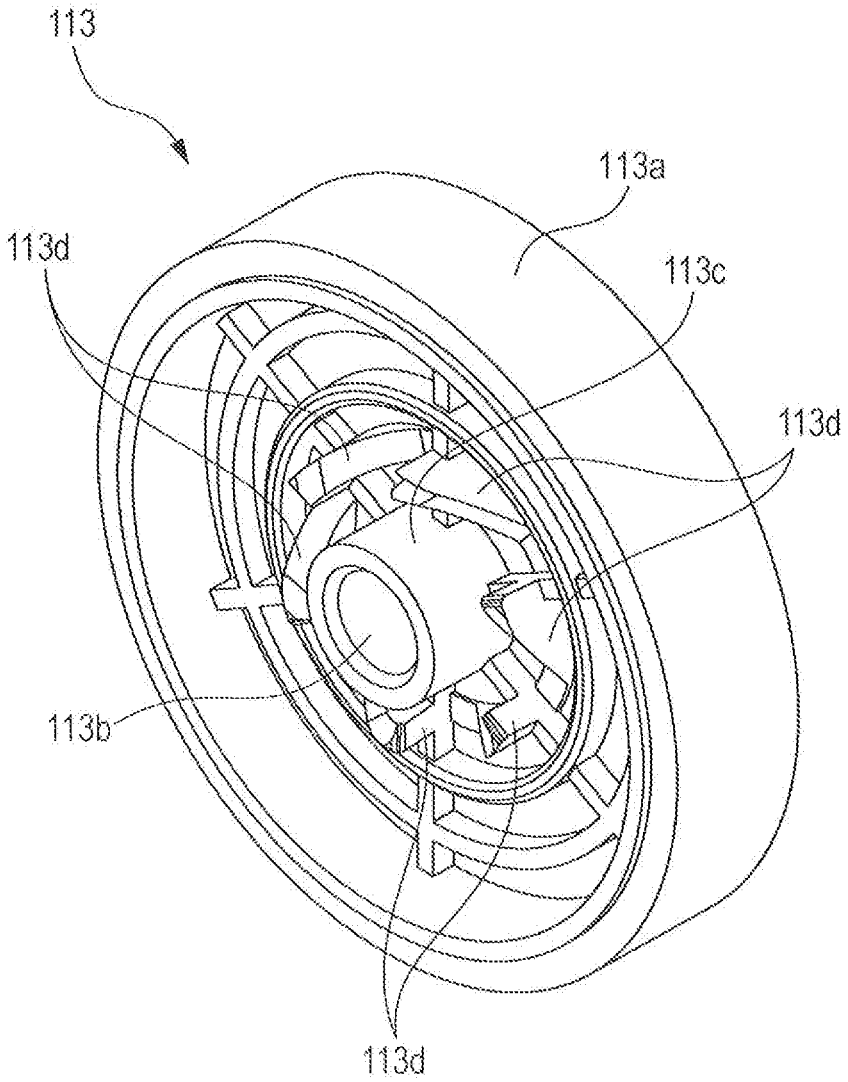
FIG. 8 is a perspective view of an output gear.
Figure 9B:
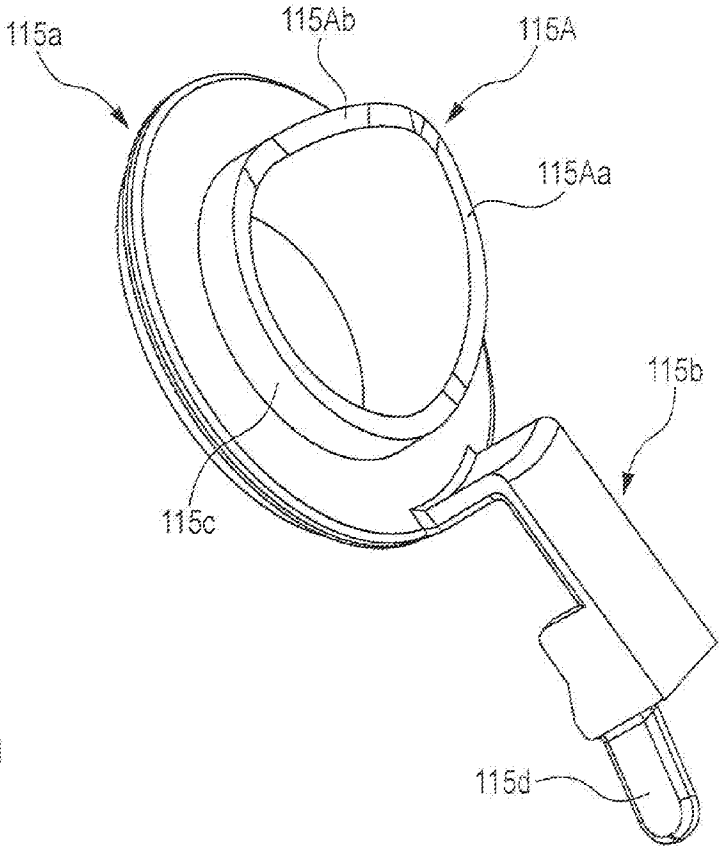
FIGS. 9A and 9B are perspective views of a moving member.
Figure 9A:
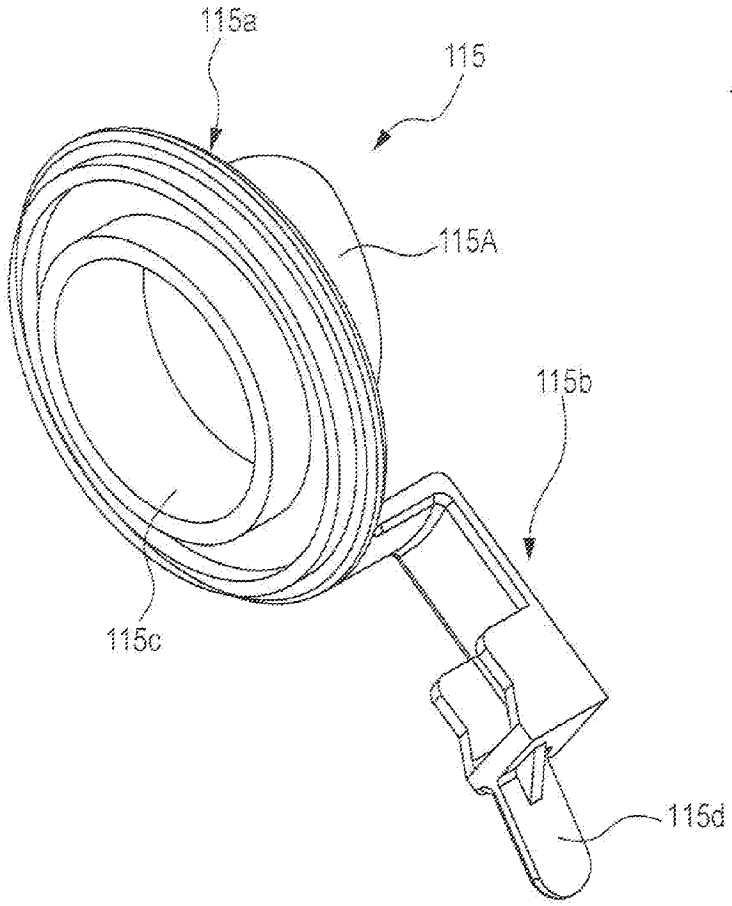
Figure 10A:
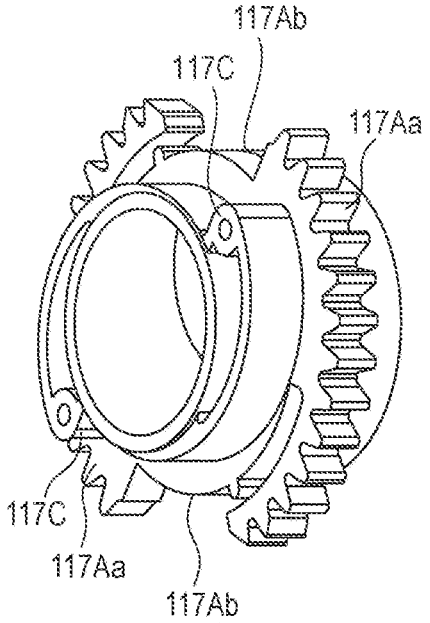
FIGS. 10A and 10C are perspective views of a cam member.
Figure 10B:
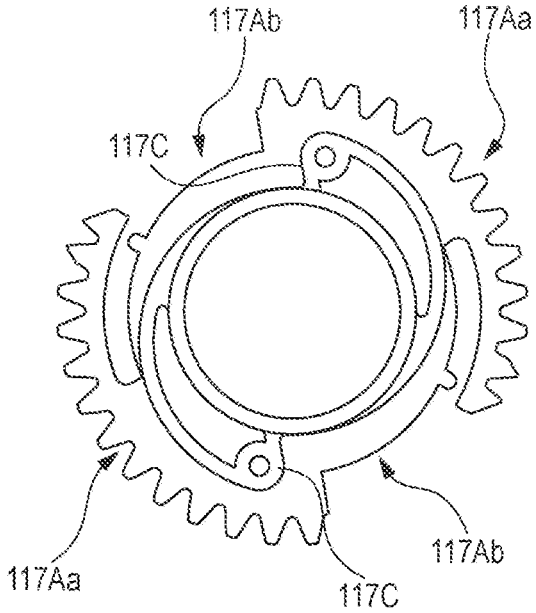
FIGS. 10B and 10D are perspective views.
Figure 10C:
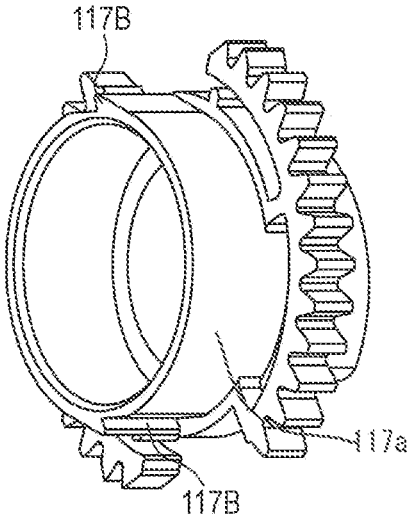
Figure 10D:
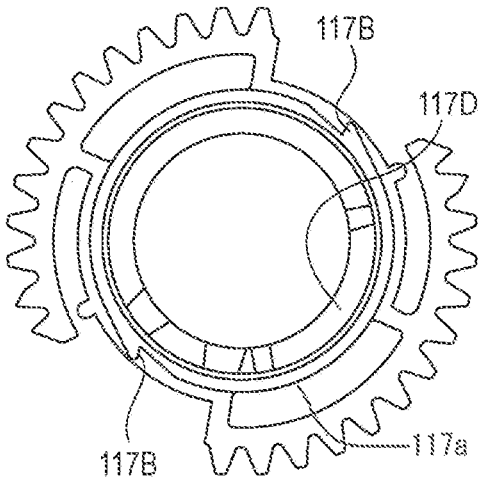

FIG. 2A is a perspective view illustrating the driving-force-transmission device 100 that includes an intermittent driving device 110 focusing on the side where transmission of a driving force is performed, and FIG. 2B is a plan view focusing on the side where the transmission of the driving force is performed. FIG. 3 is a perspective view illustrating a principal portion of the intermittent driving device 110. FIG. 4 is an exploded perspective view illustrating the principal portion of the intermittent driving device 110. FIG. 5A is a plan view illustrating the principal portion of the intermittent driving device 110, and FIG. 5B is a schematic sectional view illustrating the principal portion of the intermittent driving device 110. FIGS. 6A and 6B are perspective views each illustrating an input gear 112. FIG. 7A is a front view of a connecting member 114 on the side on which the input gear 112 is disposed, and FIG. 7B is a perspective view focusing on the side on which connecting protrusions 114*d* are present. FIG. 8 is a perspective view of an output gear 113. FIGS. 9A and 9B are perspective views of a moving member 115. FIGS. 10A and 10C are perspective views of a cam member 117, and FIGS. 10B and 10D are perspective views.

The configuration of the driving-force-transmission device 100 will be described below with reference to the drawings.

(2.1) Overall Configuration of Driving-Force-Transmission Device

The driving-force-transmission device 100 includes a frame body 101, plural gears G, first driving-joint portions 102, second driving-joint portions 103, and the intermittent driving device 110. The plural gears G, the first driving-joint portions 102, the second driving-joint portions 103, and the intermittent driving device 110 are mounted on the frame body 101. The plural gears G transmit a rotational driving force from drive motors M1 and M2 (not illustrated). The first driving-joint portions 102 transmit rotations of the gears G to the photoconductor drums 31, each of which serves as a member to be rotated. The second driving-joint portions 103 transmit rotations of the gears G to the developing rollers 42, each of which serves as a member to be rotated. The intermittent driving device 110 performs switching between a state where the rotational driving force is transmitted to the second driving-joint portions 103 and a state where the rotational driving force is not transmitted to the second driving-joint portions 103.

The photoconductor units 30 and the developing units 40 are configured to be mounted in an apparatus body along a guide rail (not illustrated) from the front surface side of the apparatus body and are connected to the apparatus body in such a manner as to receive a rotational driving force from the driving-force-transmission device 100 at predetermined positions.

(2.2) Configuration of Intermittent Driving Device

As illustrated in FIG. 3 to FIG. 10D, the intermittent driving device 110 includes a shaft 111, which is vertically arranged on the frame body 101, the input gear 112, the output gear 113, the connecting member 114, the moving member 115, a spring 116, the cam member 117, a torsion spring 118, and a switching member 119. The spring 116 serves as an urging member that urges the connecting member 114 toward the output gear 113, and the torsion spring 118 serves as a rotation-applying member that applies a force that causes the cam member 117 to rotate around the shaft 111 to the cam member 117.

As illustrated in FIGS. 6A and 6B, the input gear 112 is formed of a cylinder member with a bottom, and a gear portion 112*a* is formed on an outer peripheral portion of the input gear 112. A boss 112*c* having a shaft hole 112*b* is formed on a center portion of the gear portion 112*a*, and the shaft 111 is inserted through the shaft hole 112*b* in such a manner that the input gear 112 is rotatably supported by the shaft 111. Recesses 112*d* that engage with the connecting member 114 and transmit a rotational driving force from a driving source to the connecting member 114 are formed in an end portion of the boss 112*c*. The recesses 112*d* are formed in such a manner as to extend in an axial direction and allow the connecting member 114, which engages with the recesses 112*d*, to move in the axial direction.

As illustrated in FIGS. 7A and 7B, the connecting member 114 is a cylinder member and has a shaft hole 114*b* formed in a center portion thereof, and the shaft 111 is inserted through the shaft hole 114*b* such that the connecting member 114 is supported in such a manner as to be capable of moving in the axial direction. Protruding portions protruding inward are formed in a first end portion of the connecting member 114, and the Protruding portions engage with the recesses 112*d*, which are formed in the end portion of the boss 112*c* of the input gear 112, and receive the rotational driving force from the input gear 112. Plural connecting protrusions 114*d* protruding in the axial direction are formed in a second end portion of the connecting member 114, and the connecting protrusions 114*d* engage with to-be-connected protrusions 113*d* of the output gear 113, which will be described later, and transmit the rotational driving force received from the input gear 112 to the output gear 113.

As illustrated in FIG. 8, the output gear 113 is a member having a disc-like shape, and a gear portion 113*a* is formed on an outer peripheral portion of the output gear 113. A boss 113*c* having a shaft hole 113*b* is formed on a center portion of the gear portion 113*a*, and the shaft 111 is inserted through the shaft hole 113*b* in such a manner that the output gear 113 is rotatably supported by the shaft 111. The plural to-be-connected protrusions 113*d* are formed on one surface of the output gear 113 between the boss 113*c* and the gear portion 113*a*, and the to-be-connected protrusions 113*d* engage with the connecting protrusions 114*d* of the connecting member 114 and receive the rotational driving force from the input gear 112.

As illustrated in FIGS. 9A and 9B, the moving member 115 includes a body 115*a*, which has a circular shape, and an arm portion 115*b*, which is formed at one end of the body 115*a* in such a manner as to project outward, and a cylinder portion 115*c* extending through the body 115*a* is formed in a center portion of the body 115*a*. The outer surface of the connecting member 114 is inserted through the cylinder portion 115*c*, and accordingly, the cylinder portion 115*c* is supported in such a manner as to be capable of moving in the axial direction together with the connecting member 114. A protruding portion 115A is formed at one end of the cylinder portion 115*c* of the moving member 115. The protruding portion 115A comes into contact with a cam surface 117D of the cam member 117, which will be described later, and causes the connecting member 114 to move in the axial direction.

In the protruding portion 115A, a first inclined surface 115Aa and a second inclined surface 115Ab that is steeper than the first inclined surface 115Aa are each formed in such a manner as to be continuous with an inflection point, which is a boundary portion between the first inclined surface 115Aa and the second inclined surface 115Ab.

A light blocking portion 115*d* that blocks an optical axis of a light-sensing device SR (see FIG. 2 and FIG. 11), which is mounted on the frame body 101, is formed at an end of the arm portion 115*b*. As a result, the moving member 115 also functions as an actuator of a light-sensing device that senses a state where the connecting member 114 is connected to the output gear 113 and a state where the connecting member 114 is disconnected from the output gear 113.

As illustrated in FIGS. 10A to 10D, in the cam member 117, a partially non-toothed gear 117A is formed on a center portion of the outer peripheral surface of a body 117*a* having a cylindrical shape. The partially non-toothed gear 117A includes gear portions 117Aa and non-toothed portions 117Ab, which are formed by removing some of the teeth of the partially non-toothed gear 117A, and the gear portions 117Aa and the non-toothed portions 117Ab are formed at different positions in a circumferential direction of the outer peripheral surface of the body 117*a*. More specifically, in the partially non-toothed gear 117A, two gear portions 117Aa are formed on the outer peripheral surface of the body 117*a* within 180 degrees in the circumferential direction of the outer peripheral surface of the body 117*a*, and one of the gear portions 117Aa faces and engages with a drive gear G3 (illustrated in FIG. 11), which is disposed in the driving-force-transmission device 100, or neither of the two gear portions 117Aa engages with the drive gear G3 as a result of one of the non-toothed portions 117Ab facing the drive gear G3.

Two protruding portions 117B are formed on a first end portion of the outer peripheral surface of the body 117*a* in such a manner as to correspond to the non-toothed portions 117Ab. In a state where a swing portion 119*a* (described later), which is attached to the switching member 119 in such a manner as to be capable of swinging, engages with one of the protruding portions 117B, a rotational operation of the cam member 117 is hindered, and when the swing portion 119*a* is separated from the protruding portion 117B, the rotational operation of the cam member 117 is allowed.

Two step portions 117C are formed on a second end portion of the outer peripheral surface of the body 117*a* in such a manner as to correspond to the gear portions 117Aa. An end portion of the torsion spring 118 (illustrated in FIG. 11) whose proximal end portion is fixed to the frame body 101 comes into contact with one of the step portions 117C and applies a force that causes the cam member 117 to rotate around the shaft 111 to the cam member 117.

As a result, the cam member 117 is always in a state where one of the step portions 117C is pressed by the torsion spring 118, and when the swing portion 119*a* of the switching member 119 that has engaged with one of the protruding portions 117B is separated from the protruding portion 117B, the cam member 117 is caused to start performing the rotational operation by the pressing force applied by the torsion spring 118 (see arrow R1 in FIG. 11), and one of the gear portions 117Aa of the partially non-toothed gear 117A faces and engages with the drive gear G3.

The cam surface 117D (illustrated in FIG. 13A to FIG. 14D) is formed in the inner peripheral surface of the body 117*a*. In the cam surface 117D, a first inclined portion 117Da having a first inclination with respect to the axial direction and a second inclined portion 117Db having a second inclination that is steeper than the first inclination are each formed in such a manner as to be continuous with an inflection point, which is a boundary portion between the first inclined portion 117Da and the second inclined portion 117Db.

The first inclined portion 117Da comes into contact with the first inclined surface 115Aa of the protruding portion 115A formed in the moving member 115, and the second inclined portion 117Db comes into contact with the second inclined surface 115Ab of the protruding portion 115A formed in the moving member 115.

As a result, the cam surface 117D causes the moving member 115, which is supported in such a manner as to be capable of moving together with the connecting member 114, to move in the axial direction while being in contact with the protruding portion 115A of the moving member 115 and guides the connecting member 114 so as to enter a state of connecting to the output gear 113 or a state of being disconnected from the output gear 113.

The spring 116 is mounted between a bottom surface 112*e* of the input gear 112 and a flange portion 114*e* of the connecting member 114 and urges the connecting member 114 toward the output gear 113. As a result, in a state where the cam surface 117D of the cam member 117 is in contact with the protruding portion 115A of the moving member 115, in which the connecting member 114 has been received, and is pressing the moving member 115 down toward the input gear 112, the connecting protrusions 114*d* of the connecting member 114 and the to-be-connected protrusions 113*d* of the output gear 113 are separated from one another, and a driving force is not transmitted.

In a state where the first inclined portion 117Da or the second inclined portion 117Db of the cam surface 117D of the cam member 117 is in contact with the first inclined surface 115Aa or the second inclined surface 115Ab of the protruding portion 115A, the connecting member 114 is urged by the spring 116, so that the connecting protrusions 114*d* and the to-be-connected protrusions 113*d* of the output gear 113 engage with one another, and the driving force is transmitted.

The switching member 119 is a solenoid, and by performing a switching operation for starting or stopping application of a current to the switching member 119, the swing portion 119*a* swings so as to separate from or engage with one of the protruding portions 117B, which are formed on the outer peripheral surface of the cam member 117, so that the rotational operation of the cam member 117 is allowed or prohibited.

(3) Operation of Intermittent Driving Device

Figure 11:
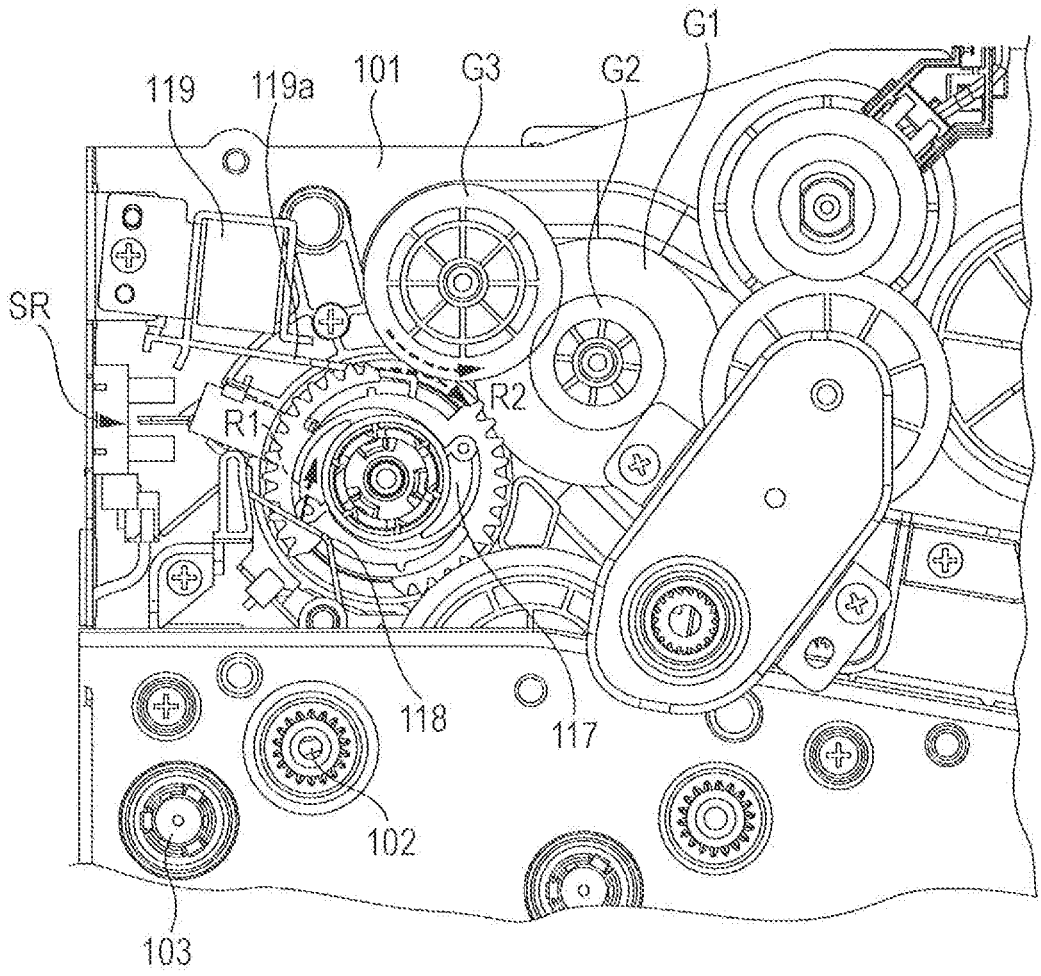
FIG. 11 is a front view illustrating, while illustration of the output gear is omitted, a position of the cam member in a state of being prohibited to rotate in the driving-force-transmission device with respect to the drive gear.
Figure 12A:
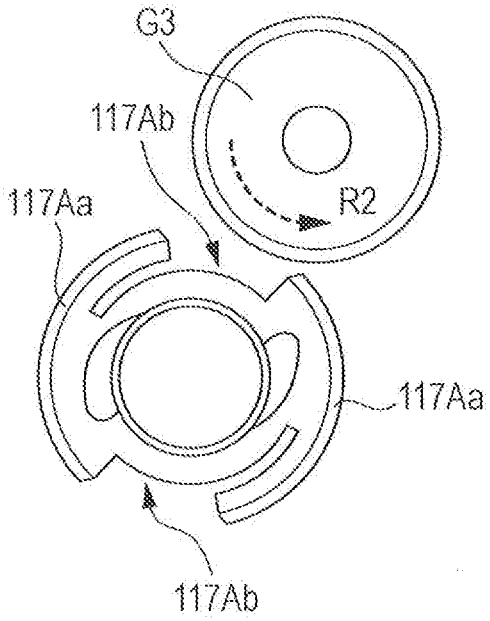
FIGS. 12A, 12B, and 12C are schematic diagrams illustrating a rotational operation of the cam member, FIG. 12A illustrating a state where the rotational operation is prohibited, FIG. 12B illustrating a state where the rotational operation is allowed and where a gear portion starts engaging with the drive gear, and FIG. 12C illustrating a state where the engagement of the gear portion and the drive gear is almost released.
Figure 12B:
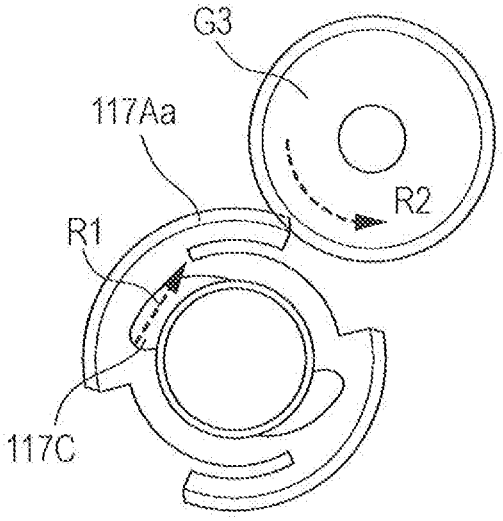
Figure 12C:
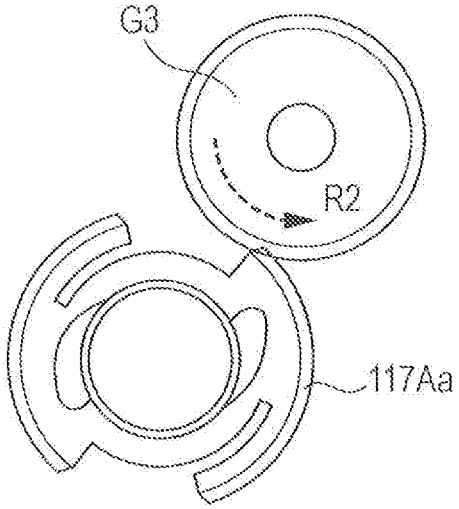

FIG. 11 is a front view illustrating, while illustration of the output gear 113 is omitted, a position of the cam member 117 in a state of being prohibited to rotate in the driving-force-transmission device 100 with respect to the drive gear G3. FIGS. 12A, 12B, and 12C are schematic diagrams illustrating a rotational operation of the cam member 117, FIG. 12A illustrating a state where the rotational operation is prohibited, FIG. 12B illustrating a state where the rotational operation is allowed and where one of the gear portions 117Aa starts engaging with the drive gear G3, and FIG. 12C illustrating a state where the engagement of the gear portion 117Aa and the drive gear G3 is almost released.

Figure 13A:
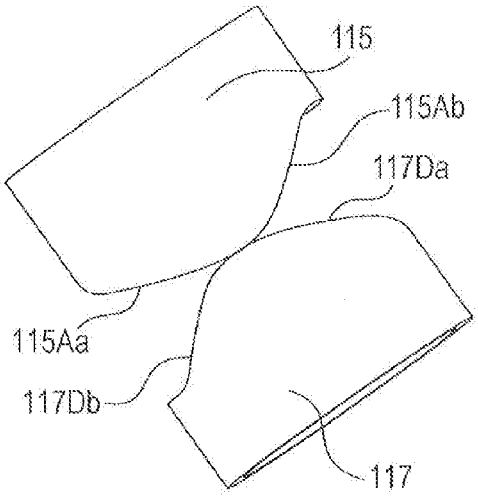
FIGS. 13A, 13B, 13C, and 13D are schematic perspective views illustrating contact states of a protruding portion of the moving member and a cam surface of the cam member, FIG. 13A illustrating a state where the input gear and the output gear are disconnected from each other, FIG. 13B illustrating the input gear and the output gear in the process of being connected to each other from the state where the input gear and the output gear are disconnected from each other, FIG. 13C illustrating a state where the input gear and the output gear are connected to each other, and FIG. 13D illustrating the input gear and the output gear in the process of being disconnected from each other from the state where the input gear and the output gear are connected to each other.
Figure 13B:
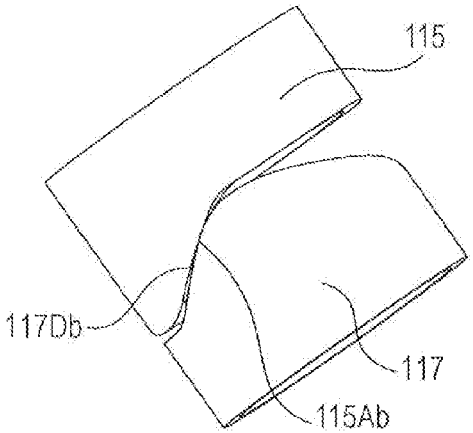
Figure 13C:
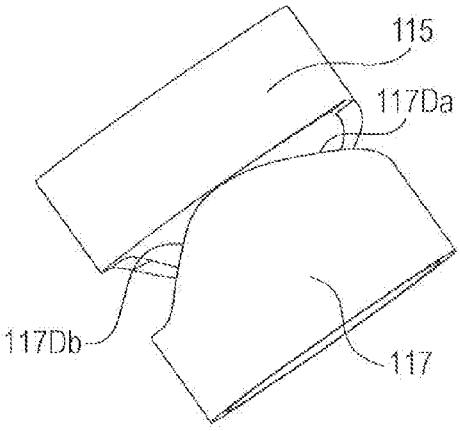
Figure 13D:
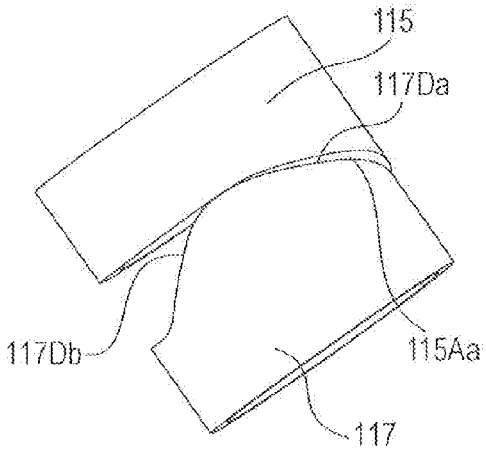

FIGS. 13A, 13B, 13C, and 13D are schematic perspective views illustrating contact states of the protruding portion 115A of the moving member 115 and the cam surface 117D of the cam member 117, FIG. 13A illustrating a state where the input gear 112 and the output gear 113 are disconnected from each other, FIG. 13B illustrating the input gear 112 and the output gear 113 in the process of being connected to each other from the state where the input gear 112 and the output gear 113 are disconnected from each other, FIG. 13C illustrating a state where the input gear 112 and the output gear 113 are connected to each other, and FIG. 13D illustrating the input gear 112 and the output gear 113 in the process of being disconnected from each other from the state where the input gear 112 and the output gear 113 are connected to each other.

Figure 14A:
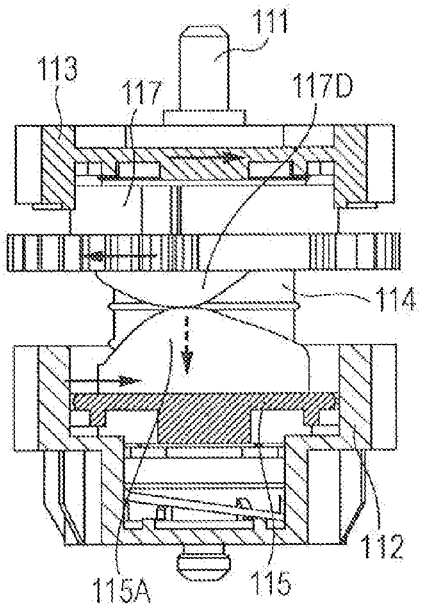
FIGS. 14A, 14B, 14C, and 14D are schematic sectional views illustrating an operating state of the intermittent driving device, FIG. 14A illustrating a state where the input gear and the output gear are disconnected from each other, FIG. 14B illustrating the input gear and the output gear in the process of being connected to each other from the state where the input gear and the output gear are disconnected from each other, FIG. 14C illustrating a state where the input gear and the output gear are connected to each other, and FIG. 14D illustrating the input gear and the output gear in the process of being disconnected from each other from the state where the input gear and the output gear are connected to each other.
Figure 14B:
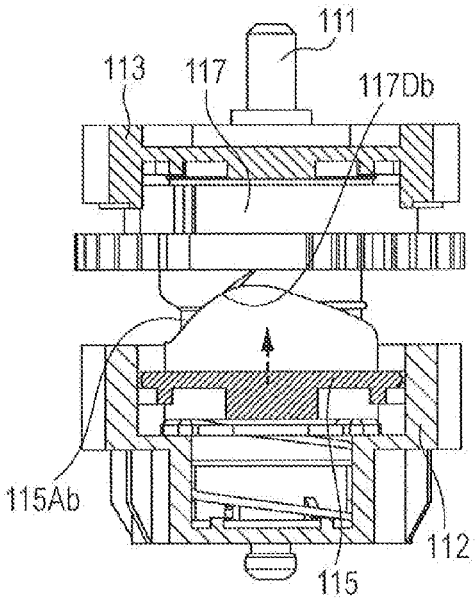
Figure 14C:
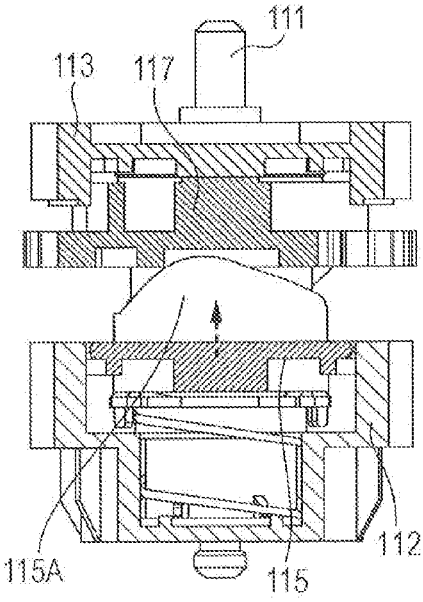
Figure 14D:
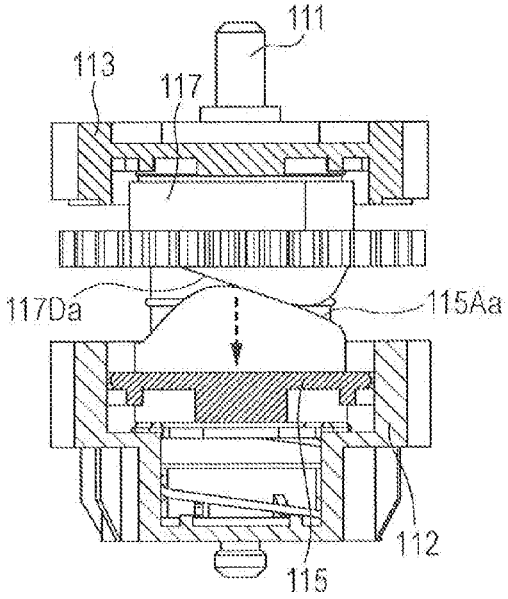

FIGS. 14A, 14B, 14C, and 14D are schematic sectional views illustrating an operating state of the intermittent driving device 110, FIG. 14A illustrating a state where the input gear 112 and the output gear 113 are disconnected from each other, FIG. 14B illustrating the input gear 112 and the output gear 113 in the process of being connected to each other from the state where the input gear 112 and the output gear 113 are disconnected from each other, FIG. 14C illustrating a state where the input gear 112 and the output gear 113 are connected to each other, and FIG. 14D illustrating the input gear 112 and the output gear 113 in the process of being disconnected from each other from the state where the input gear 112 and the output gear 113 are connected to each other.

An operation of transmitting a driving force and an operation of stopping transmission of the driving force performed by the intermittent driving device 110 will be described below with reference to the drawings.

As illustrated in FIG. 11, in the driving-force-transmission device 100, a rotational driving force from the drive motor M1 (not illustrated) is transmitted to the input gear 112 of the intermittent driving device 110 via a gear G1. A gear G2 is formed integrally with the gear G1 in such a manner as to be coaxial with the gear G1 and transmits the rotational driving force to the drive gear G3, and the drive gear G3 drives the cam member 117 by engaging with one of the gear portions 117Aa of the cam member 117 so that the cam member 117 rotates. As a result, the input gear 112, which is driven via the gear G1 so as to rotate, and the cam member 117, which is driven via the drive gear G3 so as to rotate, rotate in opposite directions.

First, in a state where a current is not applied to the switching member 119, an end portion of the swing portion 119*a* of the switching member 119 engages with one of the protruding portions 117B (first protruding portion 117B) of the cam member 117, and one of the non-toothed portions 117Ab (first non-toothed portion 117Ab) faces the drive gear G3, so that the rotational operation of the cam member 117 is hindered (see FIG. 12A).

In this state, the cam surface 117D of the cam member 117 is in contact with the protruding portion 115A of the moving member 115 and presses the moving member 115 down toward the input gear 112, and a driving force is not transmitted (see FIG. 13A and FIG. 14A). Thus, only the input gear 112, which receives a rotational driving force from the gear G1, rotates, and the second driving-joint portions 103, each of which receives the rotational driving force from the drive motor M1 via the intermittent driving device 110, stop rotating, so that the developing rollers 42 do not rotate.

Next, when the application of the current to the switching member 119 is started, the end portion of the swing portion 119*a* of the switching member 119 is separated from the first protruding portion 117B of the cam member 117, and the rotational operation of the cam member 117 is allowed. Then, the cam member 117 is caused to start performing the rotational operation by the pressing force of the torsion spring 118, and one of the gear portions 117Aa (first gear portion 117Aa) of the partially non-toothed gear 117A faces and engages with the drive gear G3 (see FIG. 12B).

Regarding the contact state of the cam surface 117D of the cam member 117 and the protruding portion 115A of the moving member 115, along with rotation of the cam member 117 (see arrow R2 in FIG. 11), the second inclined portion 117Db of the cam surface 117D, which has a steep inclination, comes into contact with the second inclined surface 115Ab of the protruding portion 115A, which is steep, (see FIG. 13B and FIG. 14B). When the cam member 117 further rotates, the cam surface 117D of the cam member 117 and the protruding portion 115A of the moving member 115 are separated from each other (see FIG. 13C).

In this state, the connecting member 114 that is urged toward the output gear 113 by the spring 116 moves toward the output gear 113 together with the moving member 115, and the connecting protrusions 114*d* engage with the to-be-connected protrusions 113*d* of the output gear 113 (see FIG. 14C).

As a result, the input gear 112 and the output gear 113 are connected to each other, and a driving force is transmitted to the output gear 113, so that the developing rollers 42 start rotating via the second driving-joint portions 103.

The cam member 117 is driven by the drive gear G3 so as to rotate, and when the cam member 117 has rotated to a position where the engagement of the first gear portion 117Aa and the drive gear G3 is released (see FIG. 12C), the end portion of the swing portion 119*a* of the switching member 119 engages with the other one of protruding portions 117B (second protruding portion 117B) of the cam member 117, and the other one of non-toothed portions 117Ab (second non-toothed portion 117Ab) faces the drive gear G3. As a result, the rotational operation of the cam member 117 is hindered (see FIG. 12A), and the connection state of the input gear 112 and the output gear 113 is maintained.

Next, when the application of the current to the switching member 119 is started at a predetermined timing at which rotations of the developing rollers 42 are stopped, the end portion of the swing portion 119*a* of the switching member 119 is separated from the second protruding portion 117B of the cam member 117, and the rotational operation of the cam member 117 is allowed. Then, the cam member 117 is caused to start the rotational operation again by the pressing force of the torsion spring 118, and the other one of gear portions 117Aa (second gear portion 117Aa) of the partially non-toothed gear 117A faces and engages with the drive gear G3 (see FIG. 12B).

Regarding the contact state of the cam surface 117D of the cam member 117 and the protruding portion 115A of the moving member 115, along with rotation of the cam member 117, the first inclined portion 117Da of the cam surface 117D, which has a small inclination, comes into contact with the first inclined surface 115Aa of the protruding portion 115A, which has a small inclination (see FIG. 13D).

When the cam member 117 further rotates, the first inclined portion 117Da of the cam surface 117D presses, while being in contact with the first inclined surface 115Aa of the protruding portion 115A, the moving member 115 down toward the input gear 112 by resisting the urging force of the spring 116 (see FIG. 14D), and the engagement of the connecting protrusions 114*d* of the connecting member 114 and the to-be-connected protrusions 113*d* of the output gear 113 is released (see FIG. 14A).

As a result, the input gear 112 and the output gear 113 are disconnected from each other, and the transmission of the driving force to the output gear 113 is stopped, so that the developing rollers 42 stop rotating.

(4) Effects of Intermittent Driving Device

In the intermittent driving device 110, the cam surface 117D having a shape that causes the moving member 115 supported in such a manner as to be capable of moving together with the connecting member 114, which rotates in a state of being movably connected to the input gear 112, to move in the axial direction and that guides the connecting member 114 so as to enter a state of being connected to the output gear 113 or a state of being disconnected from the output gear 113 and the cam member 117 that includes the partially non-toothed gear 117A, which includes the non-toothed portions 117Ab formed at different positions on the outer peripheral surface of the cam member 117, are arranged in such a manner as to be coaxial with each other.

The cam member 117 that includes the two protruding portions 117B, which engage with the swing portion 119*a* of the switching member 119 and which are formed on the outer peripheral surface of the cam member 117 in such a manner as to correspond to the non-toothed portions 117Ab, is disposed between the input gear 112 and the output gear 113 and rotates in a direction opposite to the direction in which the input gear 112 and the output gear 113 rotate.

The foregoing description of the exemplary embodiment of the present invention has been provided for the purposes of illustration and description. It is not intended to be exhaustive or to limit the invention to the precise forms disclosed. Obviously, many modifications and variations will be apparent to practitioners skilled in the art. The embodiment was chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An intermittent driving device comprising:

a shaft;

an input gear that is rotatably supported by the shaft;

an output gear that is rotatably supported by the shaft;

a connecting member that is urged and movably supported in an axial direction and that rotates in a state of being connected to the input gear, a state of the connecting member being switched between a state of being connected to the output gear and a state of being disconnected from the output gear;

a moving member that is supported in such a manner as to be capable of moving together with the connecting member;

a cam member that is supported by the shaft in such a manner as to be capable of rotating as a result of receiving a driving force of a drive gear and that has a cam surface having a shape that causes the moving member to move in the axial direction and guides the connecting member into the state of being connected to the output gear or the state of being disconnected from the output gear;

a rotation-applying member that applies a force that causes the cam member to rotate around the shaft to the cam member; and a switching member that switches between a state where a rotational operation of the cam member is hindered and a state where the rotational operation is allowed.

2. The intermittent driving device according to claim 1, wherein the moving member includes a protruding portion that is formed on one surface of the moving member and that comes into contact with the cam surface of the cam member and causes the connecting member to move in the axial direction.

3. The intermittent driving device according to claim 2, wherein the cam member includes a partially non-toothed gear, which includes a gear portion and a non-toothed portion formed at different positions on outer peripheral portion of the cam member, the non-toothed portion being formed by removing a portion of teeth of the partially non-toothed gear, and wherein the switching member hinders a rotational operation of the cam member by coming into contact with a protruding portion formed on the cam member and allows the rotational operation of the cam member by separating from the protruding portion such that the gear portion engages with the drive gear and performs a rotational operation.

4. The intermittent driving device according to claim 3, wherein the input gear and the cam member rotate in opposite directions.

5. The intermittent driving device according to claim 4, wherein, in the cam surface, a first inclined portion having a first inclination with respect to the axial direction and a second inclined portion having a second inclination that is steeper than the first inclination are each formed in such a manner as to be continuous with an inflection point, which is a boundary between the first inclined portion and the second inclined portion, and wherein, in the protruding portion, a first inclined surface, which comes into contact with the first inclined portion, and a second inclined surface, which comes into contact with the second inclined portion and which is steeper than the first inclined surface, are each formed in such a manner as to be continuous with an inflection point, which is a boundary between the first inclined surface and the second inclined surface.

6. The intermittent driving device according to claim 3, wherein, in the cam surface, a first inclined portion having a first inclination with respect to the axial direction and a second inclined portion having a second inclination that is steeper than the first inclination are each formed in such a manner as to be continuous with an inflection point, which is a boundary between the first inclined portion and the second inclined portion, and wherein, in the protruding portion, a first inclined surface, which comes into contact with the first inclined portion, and a second inclined surface, which comes into contact with the second inclined portion and which is steeper than the first inclined surface, are each formed in such a manner as to be continuous with an inflection point, which is a boundary between the first inclined surface and the second inclined surface.

7. The intermittent driving device according to claim 2, wherein the input gear and the cam member rotate in opposite directions.

8. The intermittent driving device according to claim 7, wherein, in the cam surface, a first inclined portion having a first inclination with respect to the axial direction and a second inclined portion having a second inclination that is steeper than the first inclination are each formed in such a manner as to be continuous with an inflection point, which is a boundary between the first inclined portion and the second inclined portion, and wherein, in the protruding portion, a first inclined surface, which comes into contact with the first inclined portion, and a second inclined surface, which comes into contact with the second inclined portion and which is steeper than the first inclined surface, are each formed in such a manner as to be continuous with an inflection point, which is a boundary between the first inclined surface and the second inclined surface.

9. The intermittent driving device according to claim 2, wherein, in the cam surface, a first inclined portion having a first inclination with respect to the axial direction and a second inclined portion having a second inclination that is steeper than the first inclination are each formed in such a manner as to be continuous with an inflection point, which is a boundary between the first inclined portion and the second inclined portion, and wherein, in the protruding portion, a first inclined surface, which comes into contact with the first inclined portion, and a second inclined surface, which comes into contact with the second inclined portion and which is steeper than the first inclined surface, are each formed in such a manner as to be continuous with an inflection point, which is a boundary between the first inclined surface and the second inclined surface.

10. The intermittent driving device according to claim 1, wherein the cam member includes a partially non-toothed gear, which includes a gear portion and a non-toothed portion formed at different positions on outer peripheral portion of the cam member, the non-toothed portion being formed by removing a portion of teeth of the partially non-toothed gear, and wherein the switching member hinders a rotational operation of the cam member by coming into contact with a protruding portion formed on the cam member and allows the rotational operation of the cam member by separating from the protruding portion such that the gear portion engages with the drive gear and performs a rotational operation.

11. The intermittent driving device according to claim 10, wherein the input gear and the cam member rotate in opposite directions.

12. The intermittent driving device according to claim 11, wherein, in the cam surface, a first inclined portion having a first inclination with respect to the axial direction and a second inclined portion having a second inclination that is steeper than the first inclination are each formed in such a manner as to be continuous with an inflection point, which is a boundary between the first inclined portion and the second inclined portion, and wherein, in the protruding portion, a first inclined surface, which comes into contact with the first inclined portion, and a second inclined surface, which comes into contact with the second inclined portion and which is steeper than the first inclined surface, are each formed in such a manner as to be continuous with an inflection point, which is a boundary between the first inclined surface and the second inclined surface.

13. The intermittent driving device according to claim 10, wherein, in the cam surface, a first inclined portion having a first inclination with respect to the axial direction and a second inclined portion having a second inclination that is steeper than the first inclination are each formed in such a manner as to be continuous with an inflection point, which is a boundary between the first inclined portion and the second inclined portion, and wherein, in the protruding portion, a first inclined surface, which comes into contact with the first inclined portion, and a second inclined surface, which comes into contact with the second inclined portion and which is steeper than the first inclined surface, are each formed in such a manner as to be continuous with an inflection point, which is a boundary between the first inclined surface and the second inclined surface.

14. The intermittent driving device according to claim 1, wherein the input gear and the cam member rotate in opposite directions.

15. The intermittent driving device according to claim 14, wherein, in the cam surface, a first inclined portion having a first inclination with respect to the axial direction and a second inclined portion having a second inclination that is steeper than the first inclination are each formed in such a manner as to be continuous with an inflection point, which is a boundary between the first inclined portion and the second inclined portion, and wherein, in the protruding portion, a first inclined surface, which comes into contact with the first inclined portion, and a second inclined surface, which comes into contact with the second inclined portion and which is steeper than the first inclined surface, are each formed in such a manner as to be continuous with an inflection point, which is a boundary between the first inclined surface and the second inclined surface.

16. The intermittent driving device according to claim 1, wherein, in the cam surface, a first inclined portion having a first inclination with respect to the axial direction and a second inclined portion having a second inclination that is steeper than the first inclination are each formed in such a manner as to be continuous with an inflection point, which is a boundary between the first inclined portion and the second inclined portion, and wherein, in the protruding portion, a first inclined surface, which comes into contact with the first inclined portion, and a second inclined surface, which comes into contact with the second inclined portion and which is steeper than the first inclined surface, are each formed in such a manner as to be continuous with an inflection point, which is a boundary between the first inclined surface and the second inclined surface.

17. An image forming apparatus comprising:

a driving source;

a gear that transmits a driving force of the driving source to an input gear; and a plurality of members to be rotated, wherein at least one of the plurality of members to be rotated is driven in such a manner as to rotate by the intermittent driving device according to claim 1.

* * * * *